US005971570A

United States Patent [19]

Simon

[11] Patent Number: 5,971,570

[45] Date of Patent: Oct. 26, 1999

[54] DECORATIVE PRISMATIC LENS JACKET FOR A LINEAL SOURCE

[76] Inventor: Jerome H. Simon, 70 Sumner St., Newton Centre, Mass. 02159

[21] Appl. No.: 08/747,617

[22] Filed: Nov. 13, 1996

Related U.S. Application Data

[60] Provisional application No. 60/006,441, Nov. 13, 1995.

[51] Int. Cl.[6] ..... F21V 5/00

[52] U.S. Cl. ..... 362/336; 362/337; 362/338; 362/339; 362/340; 362/296; 362/297

[58] Field of Search ..... 362/336, 337, 362/338, 339, 340, 347, 350, 296, 297

[56] References Cited

U.S. PATENT DOCUMENTS

| | | | |
|---|---|---|---|
| 3,532,876 | 10/1970 | Muller et al. | 362/336 |
| 3,716,710 | 2/1973 | Clostermann et al. | 362/339 |
| 4,514,793 | 4/1985 | Andreason | 362/306 |
| 4,611,266 | 9/1986 | Schwartz | 362/340 |
| 4,930,051 | 5/1990 | Golz | 362/336 |
| 5,274,536 | 12/1993 | Sato | 362/338 |
| 5,444,606 | 8/1995 | Barnes et al. | 362/340 |
| 5,479,328 | 12/1995 | Lee et al. | 362/216 |

*Primary Examiner*—Sandra O'Shea
*Assistant Examiner*—Michael J. Smith
*Attorney, Agent, or Firm*—Perkins, Smith & Cohen; Jerry Cohen; Harvey Kaye

[57] ABSTRACT

A lens jacket for surrounding all or part of the circumference of an elongated light source which includes first and second, successive light modulating means, e.g. negative focal length lens means formed therein and second lens means for producing virtual images of the source altered in shape or dispersion and direction.

18 Claims, 6 Drawing Sheets

DECORATIVE PRISMATIC LENS JACKET FOR A LINEAL SOURCE

This Appln. claims the benefit of U.S. Provisional Appln. Ser. No. 60/006,441, Filed Nov. 13, 1995.

FIELD OF INVENTION

This invention relates generally to lighting fixtures and more particularly to a device that visually alters the shape, directionality and perceived number of a single lineal light source within.

BACKGROUND OF THE INVENTION

Lineal light sources, primarily fluorescent tubes, are unattractive to view.

SUMMARY OF THE INVENTION

It is therefore an object of the present invention to provide a lens jacket, i.e. a fixture for surrounding all or part of the circumference of an elongated light source which includes lens means formed therein, for producing virtual images of the source altered in shape or dispersion and direction.

It is also an object of the present invention to provide a lens jacket of the type described having the ability to create the illusion of curves and intersections of the source.

It is another object of the present invention to provide a jacket of the type described in which the illusion is created that light emanates from shapes formed within the jacket rather than from the light source within the jacket.

In accordance with the present invention, radially directed rays strike an inner surface of the jacket and are refractively modulated. Successive refractive modulation changes one or more transmissive characteristics of the refracted light such as shape and dispersion. The combination of these elements creates virtual reimaging providing an image appearing within the surface of the jacket.

DESCRIPTION OF THE PREFERRED EMBODIMENTS

The present invention provides for a decorative lighting system capable of producing high efficiency, low maintenance partially directable lighting for residential and commercial usage. The lighting system of the present invention is capable of producing a high degree of decorative patterning without compromising light output. The present invention integrates a single linear light source with a reflective and/or refractive jacket. A first structural feature in the light jacket performs a first light modulation. For example, flutes having a negative focal length and running axially along the exterior of the light jacket may refract light. A second structural feature performs a second light modulation. Light refracted by the first feature is modulated by a second structural feature. Selected transmissive characteristics such as shape and dispersion may be changed. The first and second modulating means interact and are dimensioned to produce an altered virtual image of the source. Specific dimensions will be apparent to those skilled in the art with a minimum of adjustment. Use of convex lenses and convexly shaped surfaces having negative focal lengths is wellknown in the art.

Figure 1:
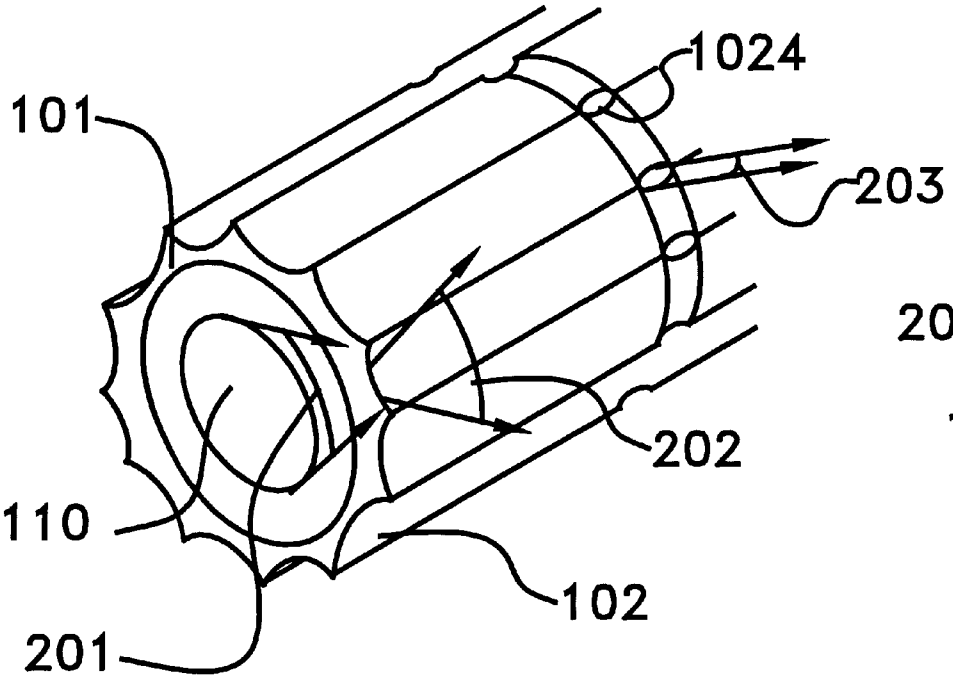
FIG. 1 is a pictorial illustration of a lineal light source such as a fluorescent lamp surrounded by a transparent tubular jacket. The jacket contain linearly disposed flutes of negative or positive cross section. Also, there are radially disposed flutes that Intersect the lineal flutes forming a set of radially disposed positive or negative surfaces.

Referring now to FIG. 1 of the drawings, the decorative prismatic light distribution system is made up of the following components: a light source 110 in the form of a linear fluorescent or neon lamp, a transparent jacket of glass or plastic 101 that is formed to contain flutes 102 (shown to be a linear negative surface but may be positive) receive light cross section 201 and increase divergence of light rays 202 creating the decorative illusion that the lamp appears thinner than It actually is. Also circumferential depressions 102A "cutting" through the flutes segment the usual effect of the flutes by adding a lens surface perpendicular to the flutes.

Figure 2:
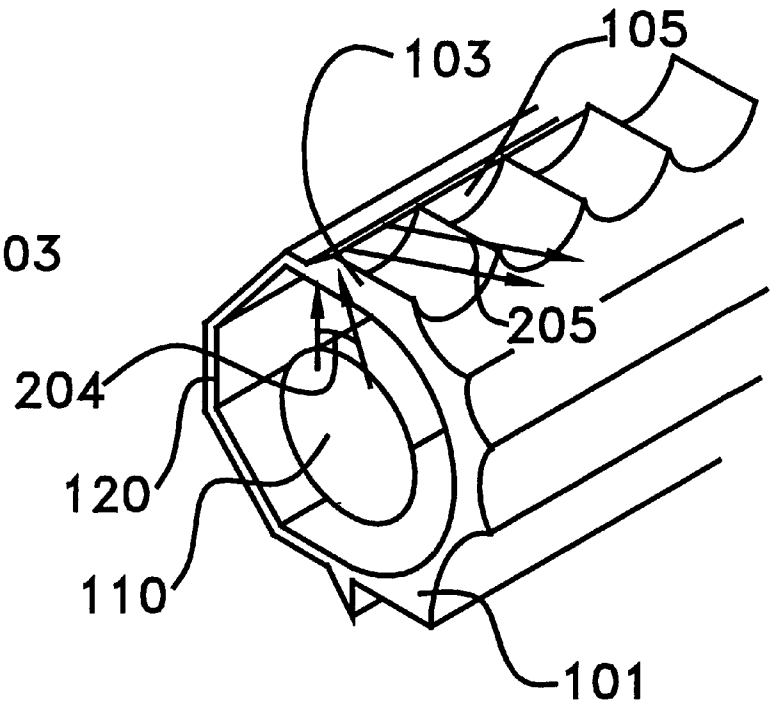
FIG. 2 is a pictorial representation of another embodiment of this invention containing a set of flutes perpendicular to a prism that is linearly disposed to the jacket.

The embodiment of FIG. 2 changes the visual the invention by bending the light path 204 through linear prism 103 projecting the rays 205 tangentially from the jacket towards the viewer. Adding to the Illusion the face of prism 103 has been formed by fluting the jacket 101 tangentially to form an arc shaped illuminated surface 105. Further a shaped reflector 120 may be added to reflect the light from light source 110 towards other surfaces of the jacket 101.

Figure 3:
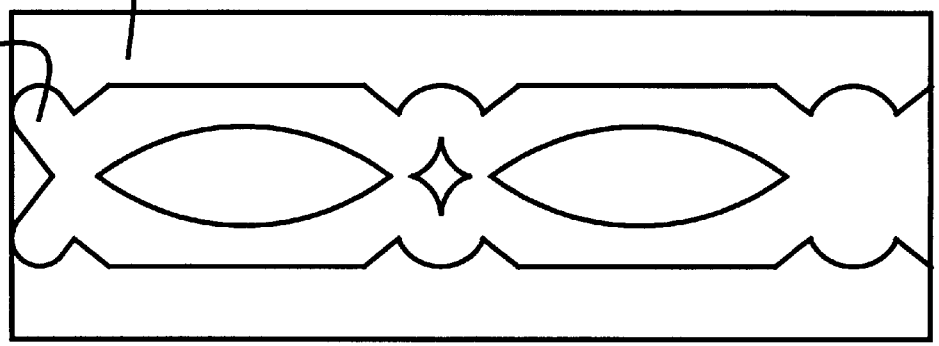
FIGS. 3 and 4 illustrate face and side views respectively of another embodiment of the invention where intersecting meniscus surfaces form radially intersecting patterns.
Figure 4:
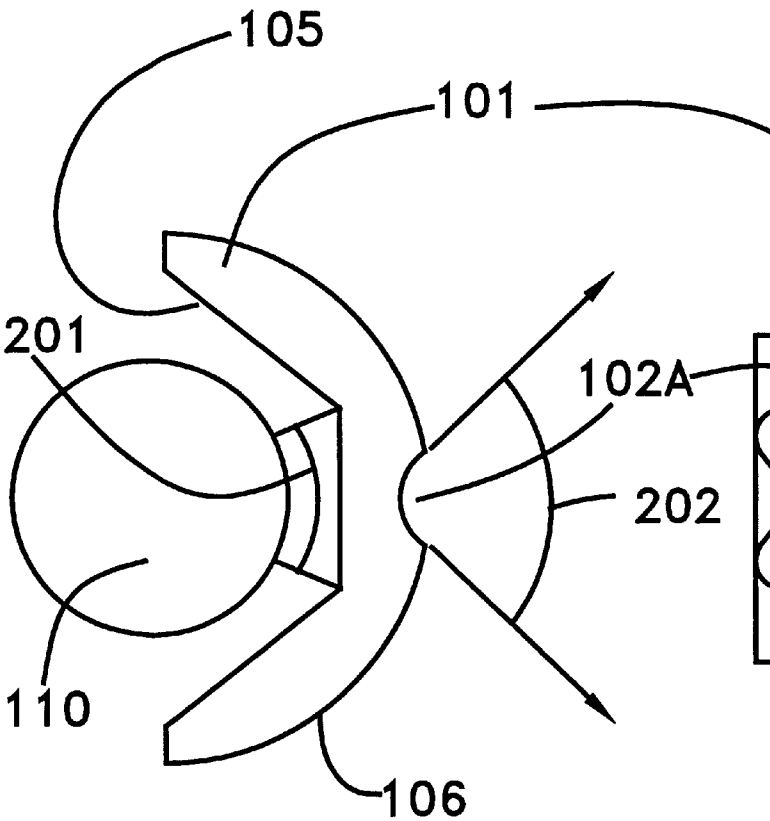

The embodiment of FIGS. 3 and 4 (shown respectively as a face and side view) show prismatic jacket 101 partially surrounding light source 110 having an entry face 105 and a fluted exit face 102A. Negative focal length flutes 102A are configured In a criss cross of circular and/or straight patterns that bend the light rays 201 and 202 so that the illusion of a line of light is following the contour of the flutes 102A. Such flutes may transverse the jacket inner surface 105 or outer surface 106.

Figure 5:
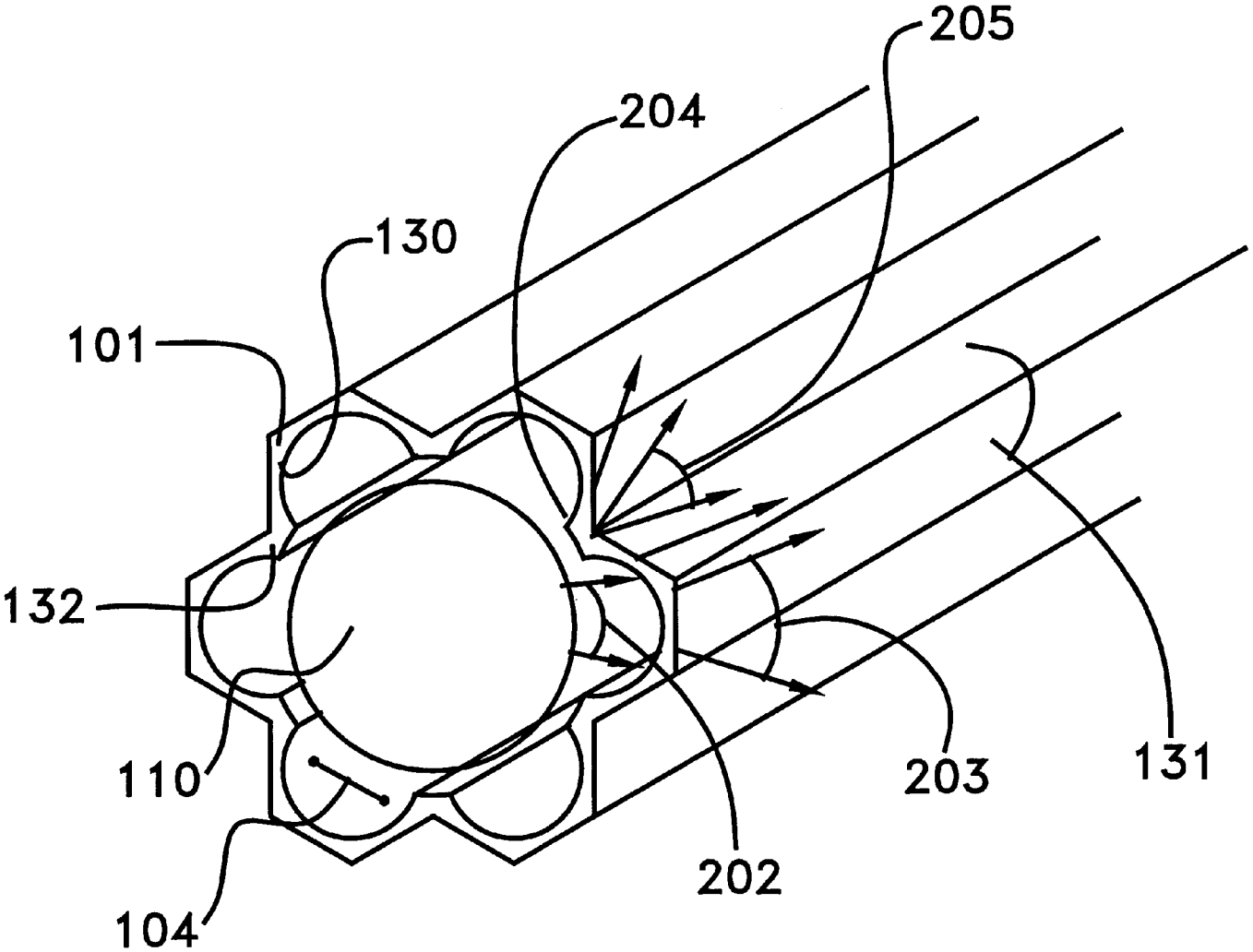
FIG. 5 is a pictorial view of another embodiment. The cross section of the jacket contains a radial pattern of linearly disposed tube sections - tube sections form spokes that are perpendicular to the light source.
Figure 6:
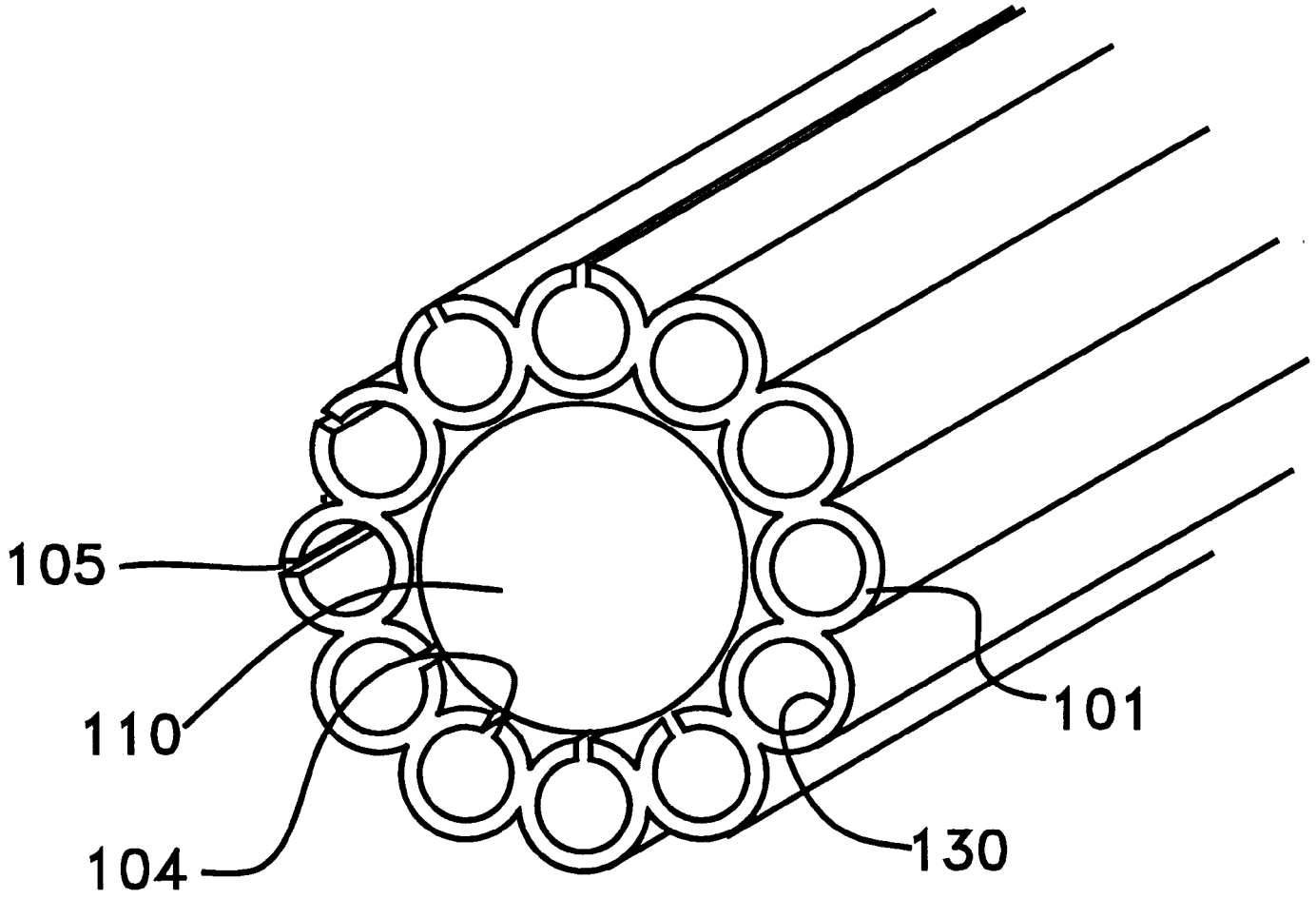
FIG. 6 is a variation of FIG. 5 showing that the tube sections may have continuous slits running through them either in the interior or exterior of the jacket.

In another embodiment of the invention as in FIGS. 5 and 6 the prismatic jacket 101 is composed sectionally of radially configured tubes 130. The tubes 130 may have radially configured surfaces 131 running linearly along the tube. Surfaces 131 may be flat, concave or convex altering the light path 202 to condense or expand as rays 203. Also, the juncture of tube 130 forms a linear spoke 132 which creates an illusion of thin bright lines of light by refracting and transporting light rays 204 as visually viewed light rays 205. This may be considered to be "edge light." In addition, tubes 130 may have partial cross sections with axial slots 105 or 104.

Figure 7:
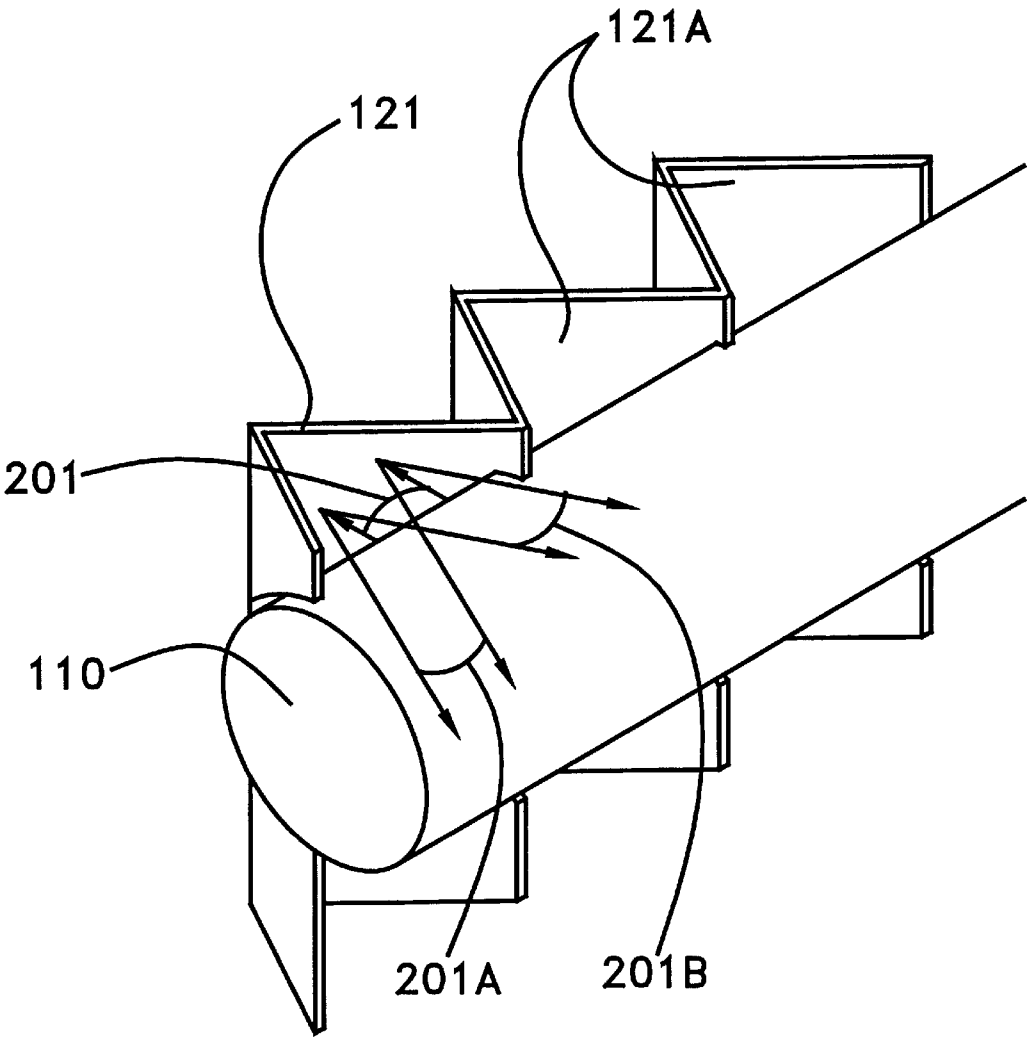
FIGS. 7 and 8 illustrate a further embodiment of the invention, pictorially showing a reflector that contains a wave pattern that may be used in combination with a jacket of the type shown in FIGS. 1, 2, 3 or 4.
Figure 8:
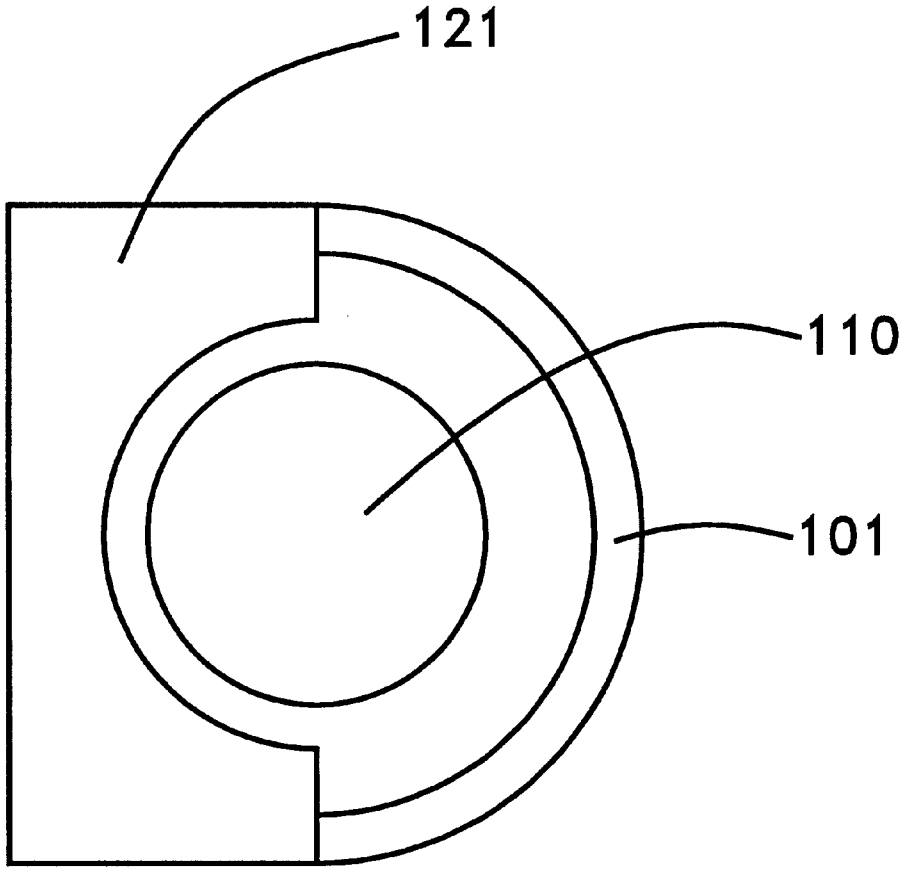

FIG. 7 and FIG. 8 show the addition of a specular reflector 121 which can be used behind light source 110 to create multiple light rays to the jacket 101. This is achieved by reflecting light path 201 off surfaces 201A and 201B in multiple direction toward prismatic jacket 101.

Jacket 101 can be any configuration as shown in FIGS. 1, 2 and 3 or as in of FIG. 5 or FIG. 6. The jacket 101 may be described as having a cylindrical envelope. The cylinder need not be a right circular cylinder. This description is applicable whether or not the jacket 101 subtends a full 360 degrees.

What is claimed as new and desired to be secured by Letters Patent of the United States is:

1. A lens jacket at least partially surrounding a lineal light source and defining a cylindrical envelope generally coaxial with the source, first modulating means for refracting light from said source, and second light modulating means formed in said jacket for redirecting light received from said first modulating means, said first and second modulating means interacting and being dimensioned to produce an altered virtual image or images of the source.

2. The lens jacket of claim 1 wherein said jacket comprises a prismatic lens configuration in which said first modulating means comprises axially disposed flutes formed on an outer surface of the lens jacket and each having a negative focal length.

3. The lens jacket of claim 2 wherein said second light modulating means comprises at least a circumferential flute intersecting said axially directed flutes.

4. The lens jacket of claim 2 wherein said lens jacket further comprises an axially disposed prism having an outer tangentially disposed surface and flute segments on the circumference of the cylinder intersecting said prism.

5. The lens jacket of claim 1 wherein an outer surface cross section is a smooth curve and in which a radial depression having a cross section defining a negative focal length is formed in said cylindrical envelope, said depression being configured in a flute extending along a curve having both axial and circumferential components.

6. The lens jacket of claim 5 wherein a cross section of an inner surface of the lens jacket is polygonal and in which a flat surface is angularly aligned with at least a portion of said curve.

7. The lens jacket of claim 6 wherein said radial depression defines a contour and criss-crosses itself.

8. A lens jacket at least partially surrounding a lineal light source and defining a cylindrical envelope generally coaxial with the source, said jacket comprising a prismatic lens configuration, said lens configuration comprising a plurality of axially extending and circumferentially adjoined tubes forming common walls, said tubes being truncated at an inner diameter of said envelope, each tube cross section comprising a negative lens, an axially extending flat surface being defined at each truncation of adjoining tubes to form a prism.

9. A lens jacket at least partially surrounding a lineal light source and defining a cylindrical envelope generally coaxial with the source, said jacket comprising a prismatic lens configuration, said lens configuration comprising a plurality of axially extending and circumferentially adjoined tubes forming common walls, inner and outer surfaces having walls therebetween defining a double negative meniscus lens, whereby two negative meniscus lenses are placed in the radial path of light from the source.

10. The lens jacket according to claim 9 in which at least one tube further comprises an axially extending slot defining adjacent radially extending surfaces intersecting each said wall, each said radially extending surface acting as an edge light aperture, whereby said slot provides said edge light aperture.

11. A lens jacket as defined in claim 1 including a specular reflector on one side of the light source for reflecting light from the reflector onto the source and/or the cylindrical envelope.

12. A lens jacket as defined in claim 2 wherein said flutes extend for a substantial portion of the length of said cylindrical envelope.

13. A lens jacket as defined in claim 2 wherein said flutes extend for substantially the entire length of said cylindrical envelope.

14. A lighting arrangement comprising a lineal light source, a specular reflector on one side of the light source having multiple reflecting surfaces for reflecting light from the reflector toward and onto the source.

15. A lighting arrangement as defined in claim 14, further comprising a cylindrical envelope partially surrounding the source and located on the opposite side thereof from the reflector.

16. A lighting arrangement as defined in claim 14, wherein said reflector has cut out portions for the lineal light source so that the lineal light source may be located close to said reflector.

17. A lighting arrangement as defined in claim 14, wherein said lineal light source extends through openings in said reflector.

18. A lens jacket as defined in claim 16, wherein said reflector has a zigzag shape.

* * * * *